US006513601B1

(12) United States Patent
Gunnarsson et al.

(10) Patent No.: US 6,513,601 B1
(45) Date of Patent: Feb. 4, 2003

(54) METHOD FOR SETTING A PACKER IN A WELL BORE, AND A PACKER

(75) Inventors: Bengt Gunnarsson, Hundvåg (NO); Per Olav Haughom, Tonstad (NO); Knut Nesland, Stavanger (NO); Jone Salte, Nærbø (NO)

(73) Assignee: Triangle Equipment AS, Forus (NO)

( * ) Notice: Subject to any disclaimer, the term of this patent is extended or adjusted under 35 U.S.C. 154(b) by 0 days.

(21) Appl. No.: 09/889,561

(22) PCT Filed: Jan. 28, 2000

(86) PCT No.: PCT/NO00/00024

§ 371 (c)(1),
(2), (4) Date: Jul. 27, 2001

(87) PCT Pub. No.: WO00/45029

PCT Pub. Date: Aug. 3, 2000

(30) Foreign Application Priority Data

| | | |
|---|---|---|
| Jan. 28, 1999 | (NO) | 19990416 |
| Jan. 28, 1999 | (NO) | 19990417 |
| Mar. 4, 1999 | (NO) | 19991085 |

(51) Int. Cl.[7] ..... E21B 23/06; E21B 33/128

(52) U.S. Cl. ..... 166/387; 166/115; 166/117.7; 166/179

(58) Field of Search ..... 166/387, 179, 166/78.1, 117.7, 115, 187

(56) References Cited

U.S. PATENT DOCUMENTS

| | | | | |
|---|---|---|---|---|
| 2,111,175 A | | 3/1938 | Cox | 103/219 |
| 4,057,118 A | | 11/1977 | Ford | 175/215 |
| 4,403,660 A | * | 9/1983 | Coone | 166/179 |
| 4,588,029 A | | 5/1986 | Blizzard | 166/120 |
| 4,630,694 A | | 12/1986 | Walton et al. | 175/391 |
| 4,923,007 A | * | 5/1990 | Sanford et al. | 166/187 |
| 5,404,944 A | * | 4/1995 | Lynde et al. | 166/117.7 |
| 6,009,951 A | * | 1/2000 | Coronado et al. | 166/127 |

FOREIGN PATENT DOCUMENTS

| | | |
|---|---|---|
| EP | 0376433 A1 | 7/1990 |
| GB | 2010943 A | 7/1979 |

* cited by examiner

*Primary Examiner*—Hoang Dang
(74) *Attorney, Agent, or Firm*—Jacobson Holman PLLC

(57) ABSTRACT

The invention relates to a method for setting a packer (7) in a well bore (1), wherein a production tubing (4) with a packer (7) is located in the well bore (1). Abrading means (11) of the packer (7) is radially expanded and rotated, for rounding the well bore wall (10), and packing means (9) are radially expanded against the rounded well bore wall (10). The invention also relates to a packer (7) to be included in a production tubing (4) in a well bore (1), comprising radially expandable and rotatable abrading means (11) for rounding the well bore wall (10), and radially expandable packing means (9), for sealing between the packer (7) and the rounded well bore wall (10).

17 Claims, 7 Drawing Sheets

METHOD FOR SETTING A PACKER IN A WELL BORE, AND A PACKER

Figure 1:
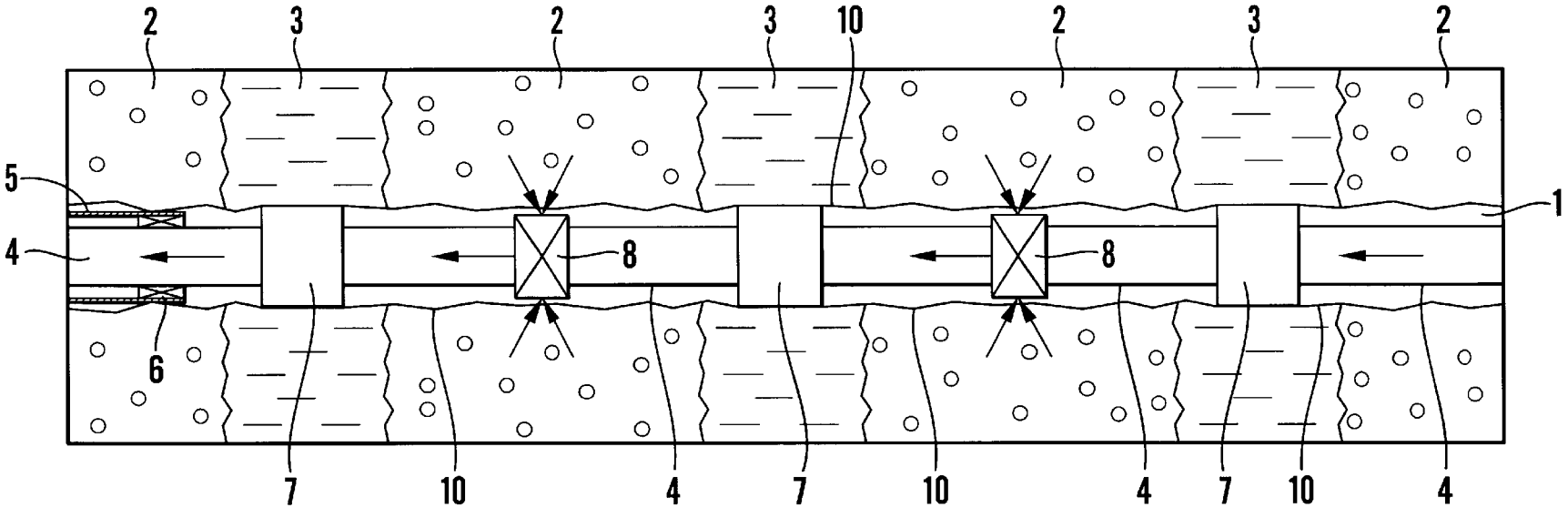

The invention relates to a method for setting a packer in a well bore, wherein a production tubing with a packer is located in the well bore, and the packer is set by a radial expansion of packing means of the packer, for sealing between the packer and the well bore wall.

The invention also relates to a packer to be included in a production tubing in a well bore, comprising a body with radially expandable packing means, for sealing between the packer and the well bore wall.

In recovery of hydrocarbons from hydrocarbon reservoirs, wells are drilled from the seabed or the surface of the earth, down to the reservoir. The wells are lined with pipes designated casing to prevent the well from collapsing. A production packer is placed in the lower end of the casing, above the reservoir, and a pipe designated production tubing is placed inside the casing, through the production packer, for conveying the hydrocarbon flow from the reservoir to the surface.

Some wells are drilled through one or more reservoirs. In such wells the tubing normally extends to the lower reservoir. In order to control the inflowing from each reservoir, and sometimes also at different places in the same reservoir, inlet valves are included in the tubing at the desired locations. In order to obtain an effective use of the inlet valves, it is required to prevent hydrocarbons from flowing along the outside of the tubing, and therefore the space between the tubing and the well bore wall is either filled with concrete or sealed by a packer between each inlet valve. Such a packer is known as an "external casing packer". Whether the pipe in the reservoir area is designated casing or tubing is a matter of terminology, or the configuration of the well, and such a packer may thus as well be called an "external tubing packer". The tubing consist of sections which are screwed together, and each end of the packer has threads, in order to be screwed in between two tubing sections. The packers are set by expanding packing means of the packer, which is done by a tool which is lowered into the packer and connected to the packer for manipulating the packing means.

A known external casing or tubing packer consist of a hollow rubber element, which is inflated by a fluid, e.g. concrete, which is injected by the tool. After injection, the concrete sets and keeps the rubber element in the inflated position, in which it seals between the tubing and the well bore wall. This type of packer is encumbered with the drawback that the rubber element may be damaged during the installation or inflation. Further the temperature, pressure and well fluids adversely influence the integrity of the rubber, and therefor the lifetime of such a packer is often shorter than desired. Therefore, this type of packer is likely to leak.

In a production packer, and other packers intended for sealing between the inner tubing and the outer casing, the sealing is achieved by radially expandable mechanical packing means, which may be hydraulically activated by a tool which is lowered into the packer. Here the above mentioned problems related to the inflatable rubber element do not exist. These packers, do, however, require that the outer contact surface, i.e. the inside of the casing, is circular. Although a well is drilled by a circular bit, the well bore wall is far less circular than the inside of the casing. Known packer designs which are intended for sealing between the tubing and the casing are therefore unsuitable to establish a proper seal between the tubing and the well bore wall.

U.S. Pat. No. 4,057,118 A describes a packer comprising a body with radially packing means for sealing between the packer and the well bore wall, wherein the packer has rotatable connections between the body and the tubing.

U.S. Pat. No. 4,057,118 A further describes a method for setting a packer in a well bore, wherein a tubular member with a packer is located in the well bore.

The object of the invention is to provide a method for setting a packer and a packer in which the above problems related to leakage are reduced or eliminated.

The objects are achieved according to the invention with a method and a packer of the type mentioned in the introduction which are characterized by the features which are stated in the independent claims.

The invention thus relates to a method for setting a packer in a well bore, wherein a production tubing with a packer is located in the well bore, and the packer is set by a radial expansion of packing means of the packer, for sealing between the packer and the well bore wall. When setting the packer, radially expandable abrading means of the packer are radially expanded and rotated. This causes an abrading, i.e. a milling or grinding, of the well bore wall, and thus a rounding of the well bore wall. Further the radially expandable packing means are expanded against the rounded well bore wall. The packing means thereby establishes a seal between the packer and the well bore wall in which the above mentioned problem related to leakage between radially expandable packing means and a not circular outer contact surface, i.e. the well bore wall, is reduced or eliminated.

The invention also relates to a packer to be included in a production tubing in a well bore, comprising a body with radially expandable packing means, for sealing between the packer and the well bore wall. The packer comprises radially expandable abrading means, expander means for radially expanding the abrading means, rotatable connections between the packer body and the production tubing, and gripping means for an operational connection between the packer body and an external rotating means. A radial expansion of the abrading means and a rotation of the packer body, i.e. a rotation of the abrading means, causes a rounding of the well bore wall.

The packing means and the abrading means may thus be formed by separate elements, which are radially expanded by separate mechanisms. The abrading means may be radially expanded prior to the expanding of the packing means. This allows a removal of cuttings from the rounding of the well bore wall prior to the expanding of the packing means. A removal of the cuttings can be done mechanically or by flushing with a flushing fluid which is externally supplied.

Alternatively the packing means may be radially expanded simultaneously with the radial expanding and rotating of the abrading means. The rounding of the well bore wall may then be done by abrading lugs arranged on the packing means, i.e. the packing means and the abrading means are constituted by the same elements. This enables a simple and compact design. The cuttings may be removed in the longitudinal direction by the abrading lugs being arranged in at least one helical pattern on the packing means.

Instead of removing the cuttings, the cuttings may be pressed against the well bore wall by the packing means, the cuttings thereby forming a seal cake.

The packer may have an elastic seal on the outside of the packing means, underneath the abrading lugs. When radially expanding the packing means, the elastic seal will also be radially expanded. Depending on whether the cuttings are removed or maintained in place, the elastic seal will be pressed between the packing means and the well bore wall or the seal cake made from the cuttings, respectively. The elastic seal distributes the pressure from the packing means and ensures a proper sealing.

The rotatable connections between the packer body and the production tubing may be formed by threaded connections between the tubing and packer end portions, and swivels between the packer end portions and the packer body.

The rotating means for rotating the packer body may be a rotational tool which is lowered into the well bore and operationally connected to the packer body. This operational connection may be carried out by lowering the rotational tool into the packer, and radially expanding gripping means of the rotational tool against the inside of the packer body.

Other ways of rotating the packer body are also conceivable, e.g. a rotation by the drill string.

The expander means may comprise a hydraulic cylinder and piston on each side of the radially expandable packing means, and a hydraulic fluid supply to the cylinders for generating a longitudinal movement of the pistons. These pistons may be connected to coacting conical surfaces which are connected to or constitute the radially expandable packing means/abrading means, and which by the longitudinal movement of the pistons provide a radial expansion of the packing means. The packer may have ratchet means in order to prevent the return of the packing means from a radially expanded position. The hydraulic fluid supply to the cylinders may be adapted to connect to a mating hydraulic fluid supply from the rotational tool.

Figure 2:
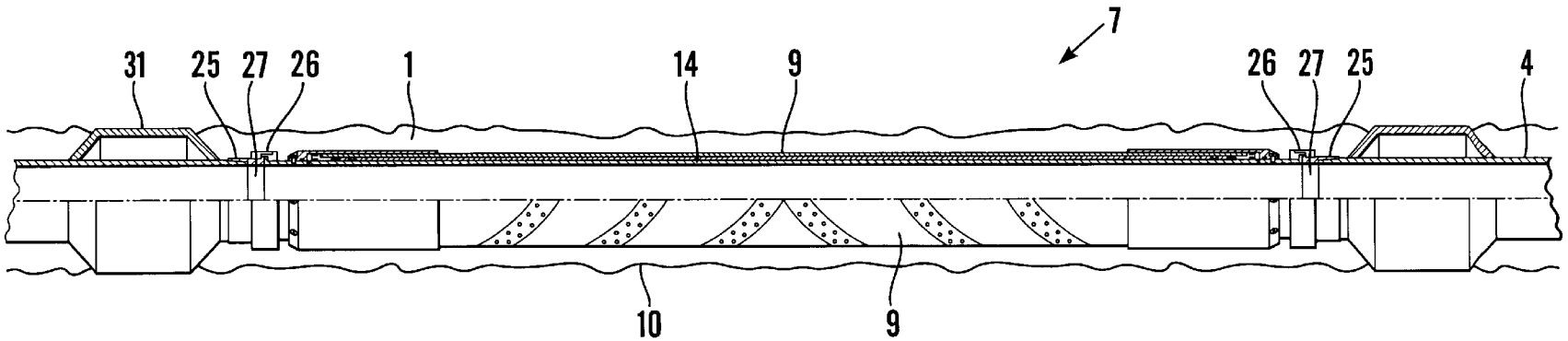
Figure 3:
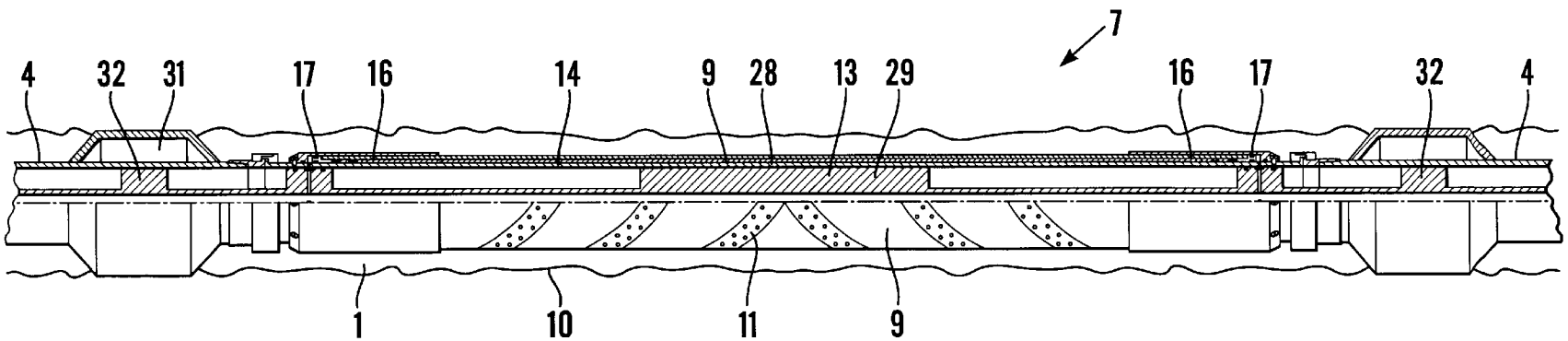
Figure 4:
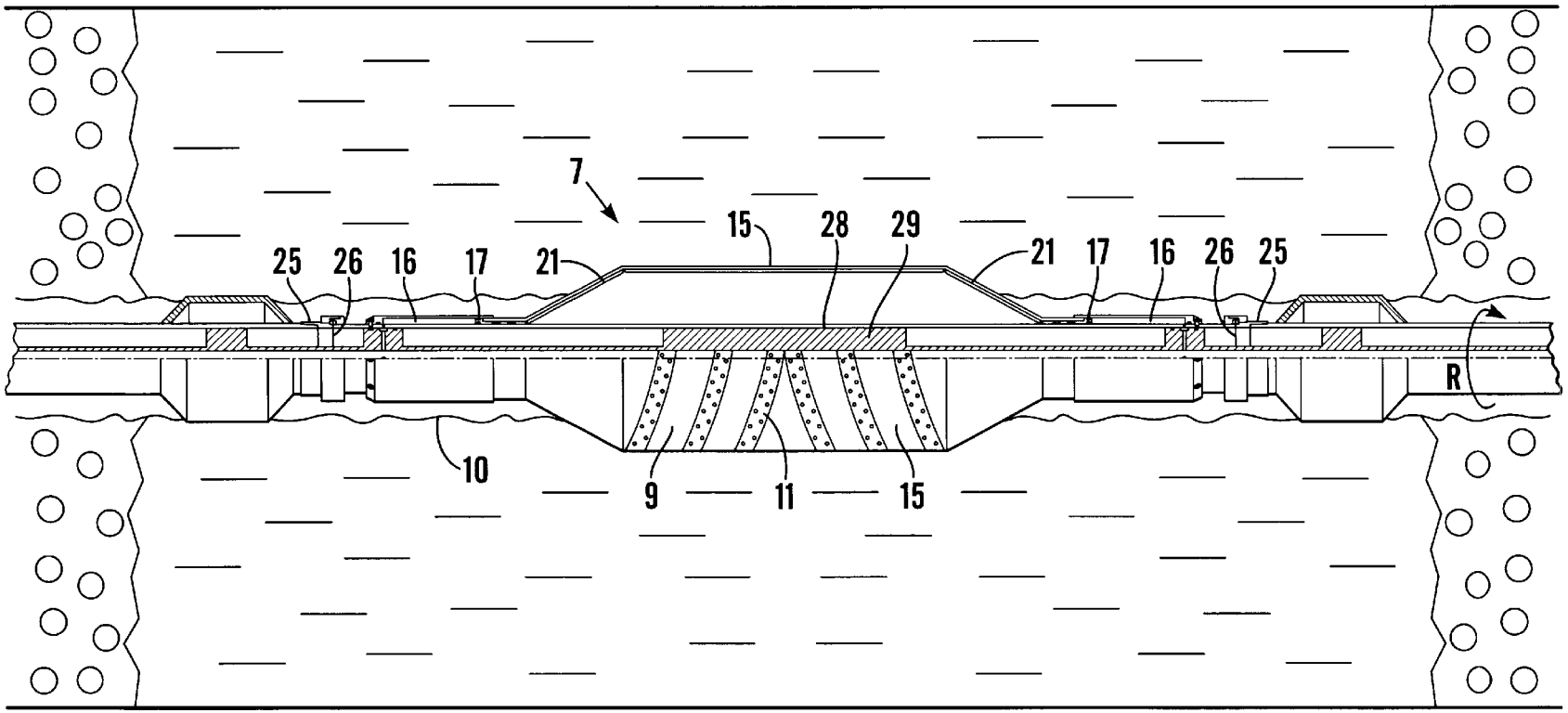
Figure 5:
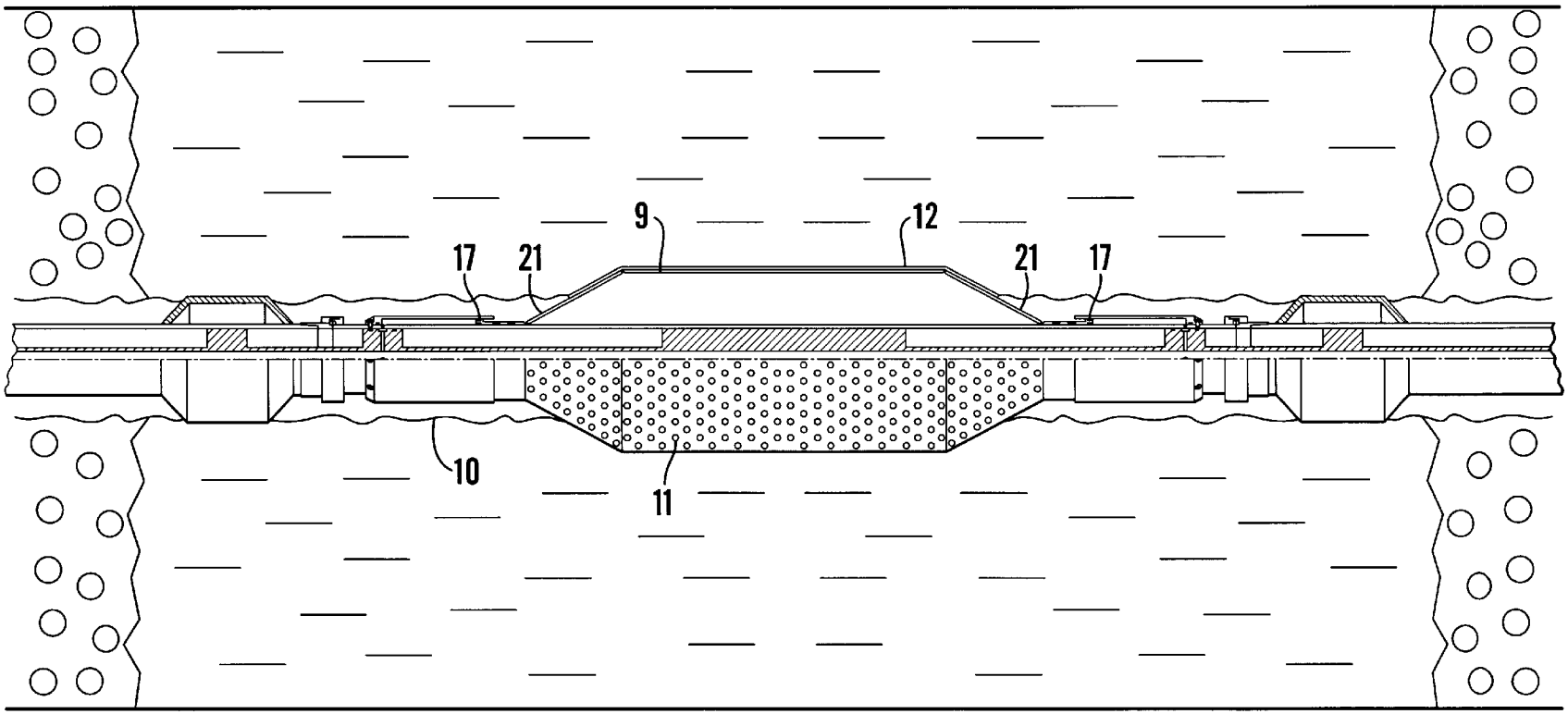
Figure 6:
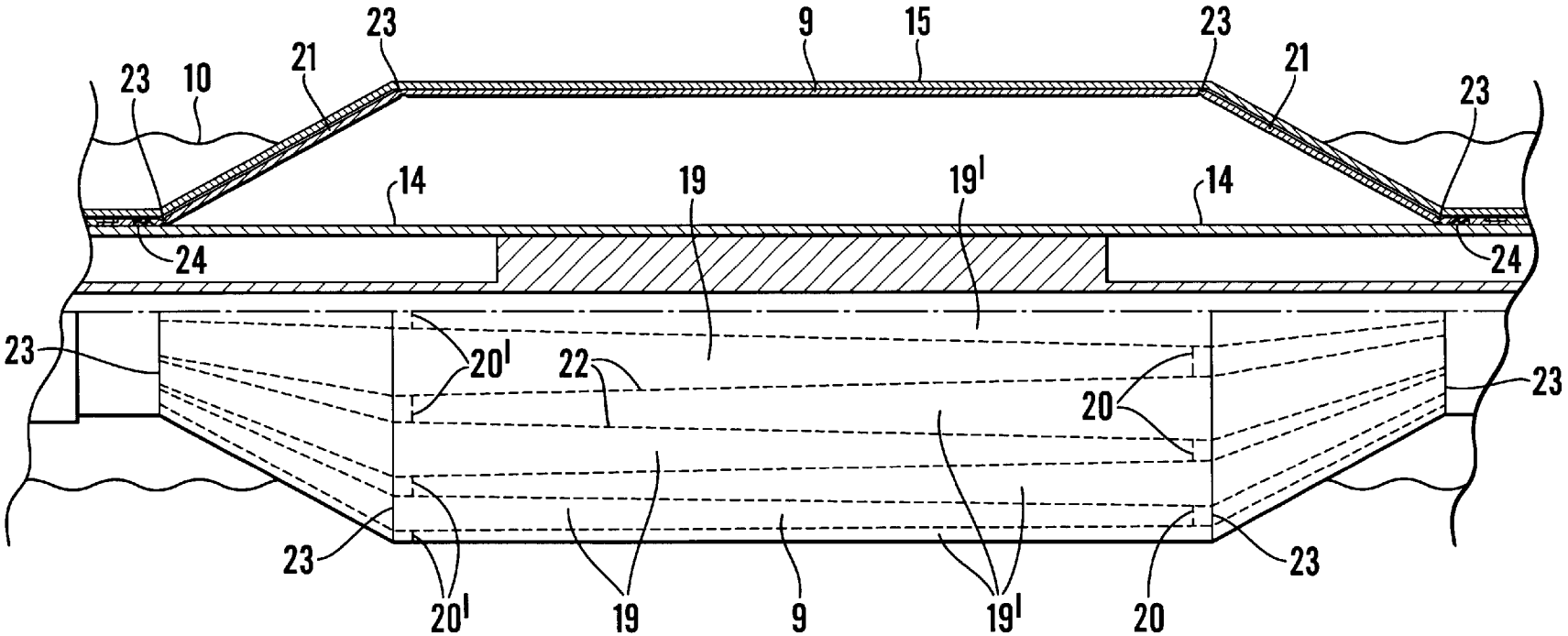
Figure 7:
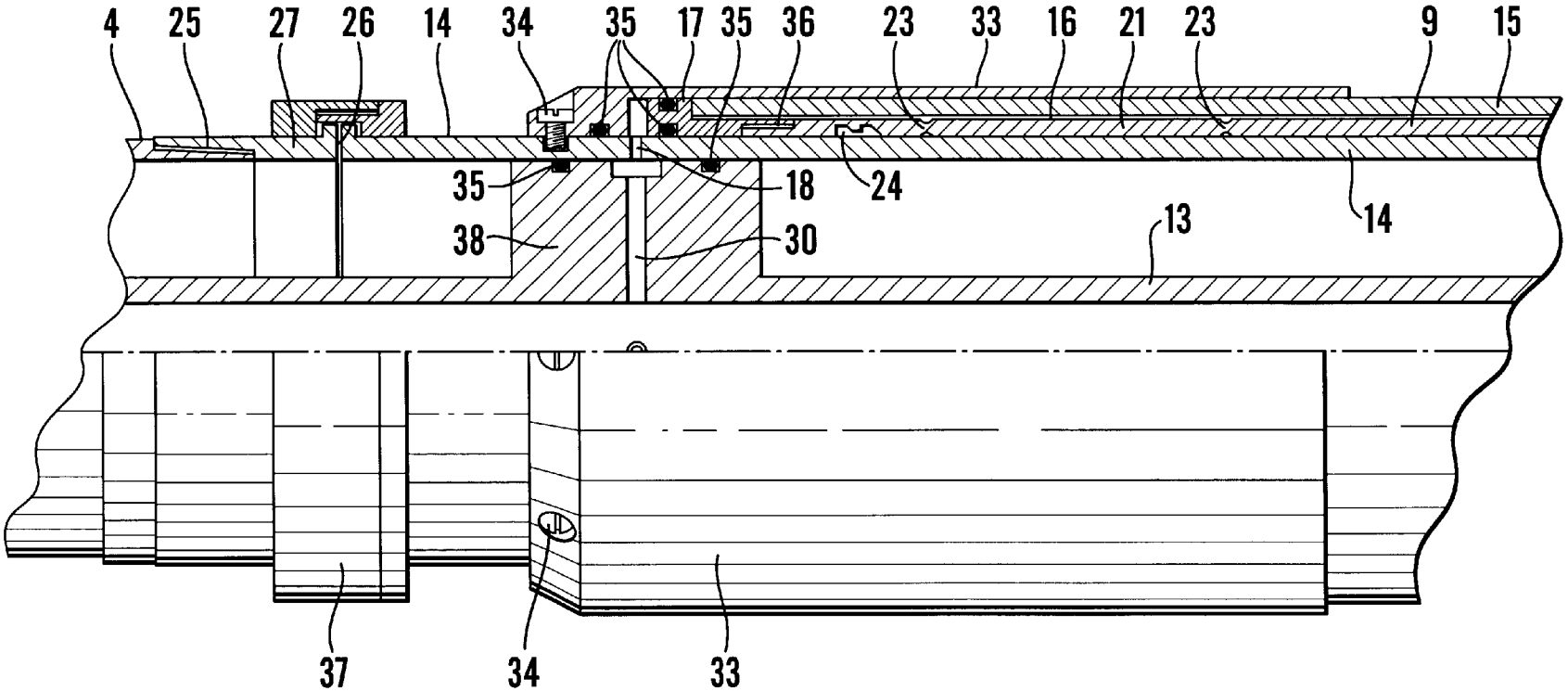
Figure 8:
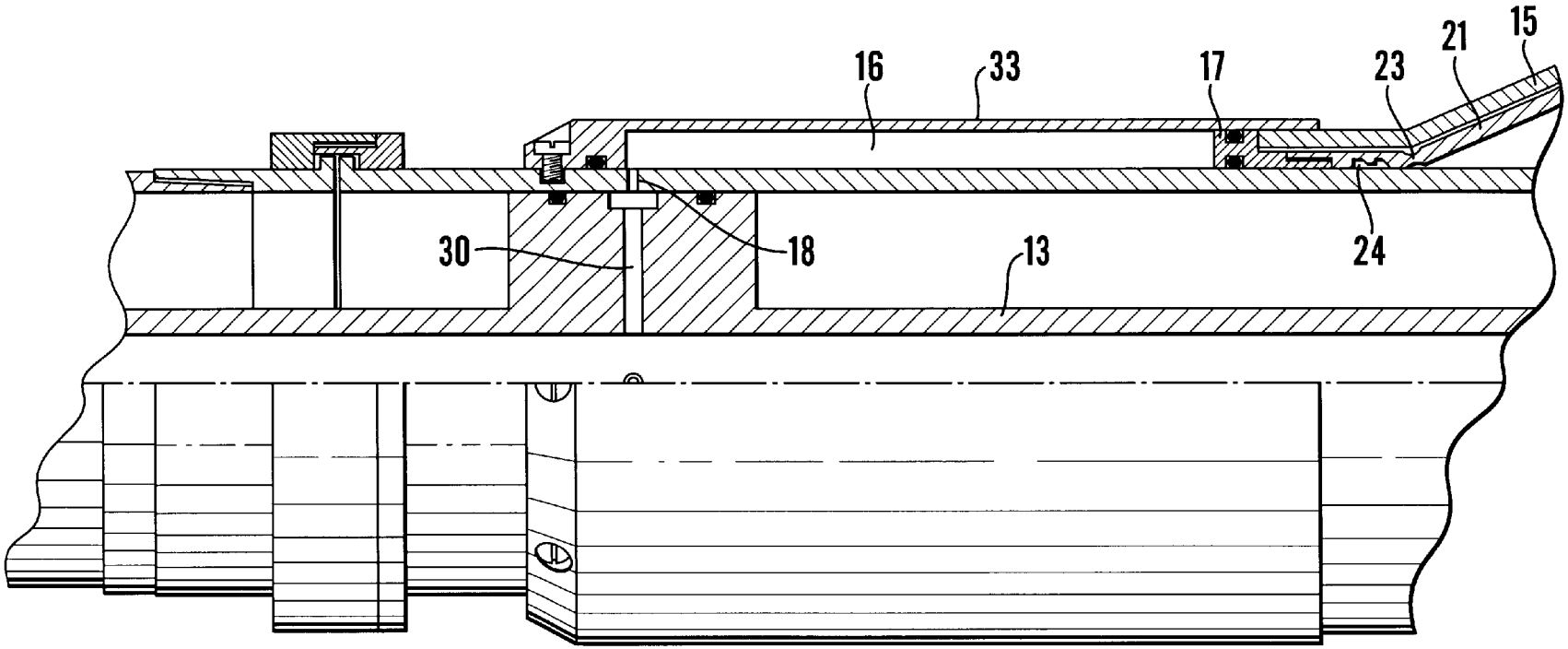

The invention will now be explained in more detail in connection with a description of a specific embodiment, and with reference to the drawings, in which:

FIG. 1 illustrates locations of packers according to the invention in a well bore, FIG. 2 illustrates a packer according to the invention, the packer body is partly cut away to show the inside of the packer, FIG. 3 illustrates the packer in FIG. 2 with a rotational tool inserted in the packer, FIG. 4 illustrates the packer in FIG. 3 after a radial expansion of packing means, FIG. 5 illustrates a variant of the packer according to the invention after a radial expansion of packing means, FIG. 6 illustrates principal parts of the packer in FIG. 4 in closer detail, FIG. 7 illustrates a mechanism for generating a radial expansion of the packing means, prior to expansion, FIG. 8 illustrates a mechanism for generating a radial expansion of the packing means, after expansion.

FIG. 1 illustrates locations of packers 7 according to the invention in a well bore 1. The well bore 1 has been drilled from a surface, which is on the left side of FIG. 1, to drain various hydrocarbon reservoir strata 2. A casing 5 has been lowered into the well bore, to prevent the well from collapsing. The casing 5 is terminated in a production packer 6 above the uppermost reservoir 2. A tubing 4 has been lowered into the casing 5, through the production packer 6, and further down to the reservoirs 2.

The reservoir strata 2 are separated by non permeable strata 3, and in order to obtain an optimum draining of the reservoirs, it is required to control the inflowing from each reservoir 2. This control is achieved by inlet valves 8, which are integral parts of the tubing 4. In order to obtain an effective use of the inlet valves 8, it is required to prevent hydrocarbons from flowing between the reservoirs 2 along the outside of the tubing 4, and the space between the tubing 4 and the well bore wall 10 is therefore sealed by a packer 7 between each inlet valve 8. Like the inlet valves 8, the packers 7 are integral parts of the tubing 4.

FIG. 2 illustrates a packer 7 according to the invention in a wellbore 1. The upper portion of the packer is cut away to show the inside of the packer. The packer comprises a body 14 with radially expandable packing means 9, for sealing between the packer 7 and the well bore wall 10. The packer body 14 is rotatably connected to the tubing 4, which is achieved by threaded connections 25 between the tubing 4 and packer end portions 27, and swivels 26 between the packer end portions 27 and the packer body 14. Centralizers 31 are included as a part of the tubing 4 adjacent to the packer 7, for keeping the packer 7 essentially in the centre of the well bore 1. Both the threaded connections 25, the swivels 26 and the centralizers 31 are of a known design. It is seen that the inside of the packer is empty, and hydrocarbons are thus free to pass through the packer.

FIG. 3 illustrates the packer in FIG. 2 with a schematically illustrated rotational tool 13 inserted into the packer 7. The rotational tool is lowered into the packer 7 by coiled tubing or a drill string. The rotational tool 13 comprises gripping means 29 which is adapted to mate with gripping means 28 of the packer body 14. The gripping means 29 is formed by radially expandable grippers, and the gripping means 28 is constituted by the inside of the packer body 14. A radial expansion of the gripping means 29 into a frictional contact with the inside 28 of the packer body thus establishes an operational connection between the packer body 14 and the rotational tool 13.

Further the rotational tool 13 comprises gripping means 32 for gripping the tubing 4. The gripping means 32 is also formed by radially expandable grippers, which by a radial expansion into a frictional contact with the inside of the tubing 4 adjacent to the packer 7 can secure the rotational tool 13 to the tubing. Energising and control of the rotational tool 13 and its gripping means is obtained by electric wiring and/or conduits for supplying pressurised hydraulic fluid from the surface. Expansion of the gripping means is achieved by electric motors or hydraulic cylinders, which is known technology.

The central part of the rotational tool 13, comprising the gripping means 29, can be rotated by an electric or hydraulic motor, or the drill string. A not illustrated swivel arrangement between the central part of the rotational tool 13 and the parts of the rotational tool 13 comprising the gripping means 32 for the tubing 4, allows the gripping means 32 to be kept stationary while the gripping means 29 rotates. An activating of the gripping means 29 and 32 and a rotation of the central part of the rotational tool 13 thus causes a rotation of the packer body 14.

FIG. 3 also illustrates a hydraulic cylinder 16 and a piston 17 on each side of the radially expandable packing means 9. The purpose of the hydraulic cylinder 16, the piston 17 and related items is to generate the radial expansion of the packing means 9, which will be discussed later.

When setting a packer according to prior art, the packing means are expanded against the well bore wall. Although the well bore 1 is drilled by a circular bit, the well bore wall 10 is due to various reasons not circular. This means that a packer which is set according to prior art in the well bore 1 will not fully seal the space between the packer 7 and the well bore wall 10.

A setting of a packer according to the invention is carried out by radially expanding and rotating abrading means of the packer 7. This causes a rounding of the well bore wall 10. Further the setting of the packer comprises radially expanding the packing means 9 against the rounded well bore wall 10.

The radial expanding of the abrading means may take place prior to the expanding of the packing means 9. For this purpose, the packer may comprise a separate mechanism for expanding the abrading means, and another mechanism for expanding the packing means 9. This enables a removal of cuttings from the rounding of the well bore wall 10 prior to the expanding of the packing means 9. Such a removal of cuttings can be done mechanically, or by flushing with a flushing fluid which is supplied from the surface. Thus the packing means 9 can be expanded against a clean, rounded surface, which compared to expanding the packing means against the well bore wall without any rounding provides an improved sealing.

Alternatively the radially expanding of the packing means 9 may take place simultaneously with the radial expanding and rotating of the abrading means. This enables the combination of the abrading means and the packing means 9, and using only one mechanism for generating the expansion. Thus a more compact mechanism is obtained, which is illustrated in the figures.

Preferably the rounding of the well bore wall 10 is carried out by abrading lugs 11 on the packing means 9, as illustrated in the figures. These abrading lugs 11 can be made from a hard metal, and may be attached to the packing means 9 by bolts or rivets.

With reference to FIG. 3, a setting of a packer according to the invention thus can be carried out by rotating the packer body 14 with the packing means 9 by the rotational tool 13, as discussed above, and radially expanding the packing means 9, which will be discussed in more detail later. During the rotation and the radial expansion of the packing means 9, the abrading lugs 11 will abrade and round the well bore wall 10.

FIG. 4 illustrates the packer in FIG. 3 after a rotation and radial expansion of the packing means 9 with the abrading lugs 11. The abrading lugs 11 have rounded the well bore wall 10, and increased its diameter, and the packing means 9 are slightly expanded into the well bore wall 10.

The abrading lugs 11 may be arranged in at least one helical pattern on the packing means 9, for removal of cuttings in the longitudinal direction of the packer 7 during the rounding of the well bore wall 10. This is illustrated in FIGS. 2–4, in which the abrading lugs are arranged in two opposite helixes which meet at the centre of the packer 7, and which during a rotation of the packer in the direction R in FIG. 4 will remove the cuttings to each side of the packer.

FIGS. 2–4 further illustrate an elastic seal 15 on the outside of the packing means 9, underneath the abrading lugs 11. The elastic seal 15 distributes the pressure from the packing means 9, and ensures a proper sealing. The elastic seal 15 can be made from an elastomer, e.g. rubber. Bolts or rivets for attaching the abrading lugs 11 to the packing means 9 may extend through the elastic seal 15.

FIG. 5 illustrates a packer in the same position as the packer in FIG. 4. In FIG. 5, however, the abrading lugs 11 are uniformly distributed on the packing means 9. Further the packer in FIG. 5 have no elastic seal 15. In other aspects the packer in FIG. 5 is identical to the packers in FIGS. 2–4.

When rotating and expanding the packing means 9 with the abrading lugs 11 in FIG. 5, no cuttings will be removed. FIG. 5 thus illustrates an embodiment in which cuttings from the rounding of the well bore wall 10 is pressed against the well bore wall 10 by the packing means 9. The cuttings thereby form a seal cake 12, which improves the sealing.

Although no elastic seal is illustrated in FIG. 5, it should be understood that an elastic seal could be used in combination with the seal cake 12 to ensure a proper sealing.

The method according to the invention is not depending upon a particular way of generating the radial expansion of the abrading means and packing means. In a preferred embodiment, however, the radial expansion is generated as will be discussed with reference to FIGS. 6–8.

FIG. 7 illustrates the hydraulic cylinder 16 and piston 17 and related items in more detail, in the same position as in FIG. 3. The hydraulic cylinder 16 extends around the packer 7. The inside of the hydraulic cylinder 16 is defined by the cylindrical packer body 14, and the outside is defined by a cylindrical housing 33, which is secured by bolts 34. The piston 17 is via a connection 36 connected to an intermediate section 21, which is integral with the packing means 9. The elastic seal 15 is arranged on the outside of the intermediate section 21 and the packing means 9. The intermediate section 21 is provided with hinge portions 23, which are formed by reducing the material thickness, and thereby creating a weakened, flexible portion. A ratchet means 24 will be discussed later. A swivel housing 37 encapsulates the swivel 26.

The rotational tool 13 comprises a schematically illustrated connector 38 with a hydraulic fluid supply channel 30, for supplying pressurized hydraulic fluid to a supply channel 18 in the packer body 14, and further to the cylinder 16. For this purpose, pressurised hydraulic fluid is supplied to the rotational tool 13 from the surface. O-rings 35 prevent leakage of hydraulic fluid.

FIG. 8 illustrates the hydraulic cylinder 16 and the related items in FIG. 7 after a supply of pressurized fluid from the rotational tool 13 to the cylinder 16. The piston 17 have now due to the hydraulic pressure moved in the longitudinal direction, towards the packer 9. FIG. 8 thus correspond to FIGS. 4 and 5. The hinge portion 23 which is closest to the piston 17 has flexed, and the intermediate section 21 and the elastic seal 15 is slanting upwards.

Now turn to FIG. 6, in which the pistons have been moved towards the packing means 9, as in FIGS. 4, 5 and 8. The lower part of FIG. 6 illustrates the packing means 9 underneath the elastic seal 15. The radially expandable packing means 9 comprises two sets of coacting wedges 19, 19' which are defined by sides 22, and arranged along the circumference of the packer 7. The apexes 20, 20' of each wedge 19, 19' points in the longitudinal direction of the packer, towards the other set of wedges, and each apex 20, 20' is located between two wedges in the other set of wedges. Further, in each set of wedges 19, 19', the ends of the wedges opposite the apexes 20, 20' are connected to one of the pistons 17 via the intermediate section 21, as discussed above.

A longitudinal movement of the pistons 17 from the position in FIG. 7 to the position in FIG. 8 forces the sets of wedges 19, 19' against and in between each other. Each wedge forces the adjacent wedge in lateral direction, i.e. circumferential direction, which in combination generates a radial expansion of the packing means 9. The radial expansion of the packing means causes the intermediate sections 21 to flex in the hinge portions 23, as illustrated in FIGS. 6 and 8, to maintain the connection between the pistons 17 and the wedges 19, 19'.

It should be understood that the radially expandable packing means 9 alternatively may be formed by differently designed coacting conical surfaces connected to the pistons 17, which coacting conical surfaces by the longitudinal movement of the pistons 17 could provide a radial expansion of the packing means 9.

As mentioned, the packer also comprises ratchet means 24, see FIGS. 6–8. The purpose of the ratchet means 24 is to prevent the return of the packing means 9 from a radially expanded position. This is achieved by coacting ratchet teeth on the packer body 14, and a ratchet pawl on the ratchet means 24, in a known manner.

In the above, the method according to the invention and a packer according to the invention has been described. It should be understood, however, that a number of constructural solutions are possible to achieve the radially expandable and rotatable abrading means. In an alternative packer design, which may be used in the method according to the invention, the body of the packer may have longitudinal through going channels for permanently installed hydraulic or electrical supply lines to the inlet valves, for energising and control of the inlet valves. To achieve this, the swivels between the packer body and the packer end portions may have connectors for the through going channels, and locking means which upon activation lock the swivels in a position in which these connectors establish continuity in the through going channels. Alternatively the swivels between the packer body and the packer end portions can be dispensed with, i.e. the packer body is stationary, which allows continuity in the through going channels. Rotation of the abrading means may then be achieved by a hydraulic motor in the packer.

What is claimed is:

1. A method for setting a packer in a well bore, wherein a production tubing with a packer is located in the well bore the packer comprising rotatable abrading means, characterised by that the packer is set by radially expanding packing means of the packer for sealing between the packer and the well bore wall, radially expanding and rotating the abrading means of the packer, for rounding the well bore wall, and radially expanding the packing means against the rounded well bore wall.

2. A method according to claim 1, characterised by radially expanding the packing means simultaneously with the radial expanding and rotating of the abrading means.

3. A method according to claim 2, characterised by rounding the well bore wall by abrading lugs on the packing means.

4. A method according to claim 1, characterised by radially expanding the abrading means prior to the expanding of the packing means.

5. A method according to claim 4, characterised by removing cuttings from the rounding of the well bore wall prior to the expanding of the packing means.

6. A method according to claim 1, characterised by pressing cuttings from the rounding of the well bore wall against the well bore wall by the packing means, the cuttings thereby forming a seal cake.

7. A method according to claim 1, characterised by rotating the abrading means by a rotational tool which is lowered into the well bore and operationally connected to the abrading means.

8. A packer to be included in a production tubing in a well bore, comprising a body with radially expandable packing means, for sealing between the packer and the well bore wall, wherein the packer has rotatable connections between the body and the production tubing, characterised by radially expandable abrading means, expander means for radially expanding the abrading means, and gripping means for an operational connection between the packer body and an external rotating means, for rounding the well bore wall during a radial expansion of the abrading means and a rotation of the packer body with the abrading means.

9. A packer according to claim 8, characterized by that the radially expandable abrading means is formed by abrading lugs arranged on the packing means.

10. A packer according to claim 9, characterized by that the abrading lugs are arranged in at least one helical pattern on the packing means, for removal of cuttings in the longitudinal direction of the packer during the rounding of the well bore wall.

11. A packer according to claim 9, characterized by an elastic seal on the outside of the packing means, underneath the abrading lugs.

12. A packer according to claim 8, characterized by that the expander means comprises a hydraulic cylinder and piston on each side of the radially expandable packing means, and a hydraulic fluid supply to the cylinders for generating a longitudinal movement of the pistons, and the radially expandable packing means comprises coacting conical surfaces connected to the pistons, which coacting conical surfaces by the longitudinal movement of the pistons provide a radial expansion of the packing means.

13. A packer according to claim 12, characterized by that the radially expandable packing means comprises two sets of coacting wedges, wherein each set of wedges is arranged along the circumference of the packer, the apex of each wedge is located between two wedges in the other set of wedges, and in each set of wedges the ends of the wedges opposite the apexes are connected to one of the pistons via an intermediate section, a longitudinal movement of the pistons towards the wedges thereby forcing the sets of wedges against and in between each other, thereby pressing the wedges radially outwards, the intermediate sections flex in hinge portions to maintain the connection between the pistons and the wedges.

14. A packer according to claim 8, characterized by ratchet means to prevent the return of the packing means from a radially expanded position.

15. A packer according to claim 8, characterized by that the rotatable connections between the packer body and the production tubing are formed by threaded connections between the tubing and packer end portions, and swivels between the packer end portions and the packer body.

16. A packer according to claim 8, characterized by that the gripping means for an operational connection between the packer body and an external rotating means are adapted to mate with gripping means of a rotational tool which can be lowered into the packer.

17. A packer according to claim 12, characterized by that the hydraulic fluid supply to the cylinders are adapted to connect to a mating hydraulic fluid supply from a rotational tool which can be lowered into the packer.

* * * * *